US008689488B2

(12) United States Patent
Rodrigue et al.

(10) Patent No.: US 8,689,488 B2
(45) Date of Patent: Apr. 8, 2014

(54) LOCKING CORE PLUG

(75) Inventors: Leo Joseph Rodrigue, Beaumont (CA); Bernard Robert Rodrigue, Beaumont (CA)

(73) Assignee: 1279881 Alberta Ltd., Nisku (CA)

( * ) Notice: Subject to any disclaimer, the term of this patent is extended or adjusted under 35 U.S.C. 154(b) by 0 days.

(21) Appl. No.: 13/264,980

(22) PCT Filed: May 12, 2010

(86) PCT No.: PCT/CA2010/000733
§ 371 (c)(1),
(2), (4) Date: Oct. 17, 2011

(87) PCT Pub. No.: WO2010/130048
PCT Pub. Date: Nov. 18, 2010

(65) Prior Publication Data

US 2012/0036787 A1 Feb. 16, 2012

Related U.S. Application Data

(60) Provisional application No. 61/177,615, filed on May 12, 2009.

(51) Int. Cl.
*E06B 3/32* (2006.01)

(52) U.S. Cl.
USPC ..... 49/463; 49/465; 404/25; 52/19; 52/20

(58) Field of Classification Search
USPC ..... 49/131, 463, 465, 466; 404/25; 52/19, 52/20
See application file for complete search history.

(56) References Cited

U.S. PATENT DOCUMENTS 822,562 A * 6/1906 Tucker ..... 292/37
966,195 A * 8/1910 Golden ..... 292/36
1,458,391 A * 6/1923 Thomas ..... 137/371
(Continued)

FOREIGN PATENT DOCUMENTS

CN 2193384 Y 3/1995
CN 2393967 Y 8/2000
(Continued)

OTHER PUBLICATIONS

Written Opinion of the International Searching Authority mailed Sep. 1, 2010, in corresponding International Application No. PCT/CA2010/000733, filed May 12, 2010, 7 pages.

*Primary Examiner* — Gregory J. Strimbu
(74) *Attorney, Agent, or Firm* — Christensen O'Connor Johnson Kindness PLLC

(57) ABSTRACT

A locking core plug includes an upper plate, an insertion portion extending outward from the upper plate and forming an outer perimeter, and a locking mechanism positioned within the outer perimeter of the insertion portion. The locking mechanism includes a rotating member, a plurality of locking arms having a first end connected to the rotating member and a second end extending outward toward holes in the outer perimeter, and a plurality of guides fixedly mounted to the upper plate. Each guide engages a corresponding locking arm to convert the circular movement of the first end of the arm as rotating member rotates into a generally linear movement of the second end between a release position retracted toward or within the outer perimeter of the insertion portion and a locking position extended outward from the outer perimeter of the insertion portion.

4 Claims, 4 Drawing Sheets

(56) References Cited

U.S. PATENT DOCUMENTS

| | | | | | |
|---|---|---|---|---|---|
| 2,009,132 | A | * | 7/1935 | Gehris | 49/465 |
| 2,363,567 | A | * | 11/1944 | Blakeman | 292/6 |
| 3,375,612 | A | * | 4/1968 | Busuttil | 49/465 |
| 4,902,165 | A | * | 2/1990 | Embree | 404/25 |
| 4,964,755 | A | * | 10/1990 | Lewis et al. | 404/25 |
| 5,328,291 | A | * | 7/1994 | Wisniewski | 404/2 |
| 5,979,117 | A | | 11/1999 | Fuller | |
| 5,987,824 | A | | 11/1999 | Fuller | |
| 6,662,490 | B1 | | 12/2003 | Aesch, Jr. | |
| 6,739,796 | B1 | * | 5/2004 | Del Nero et al. | 404/25 |

FOREIGN PATENT DOCUMENTS

| | | | |
|---|---|---|---|
| CN | 2447394 | Y | 9/2001 |
| CN | 2775140 | Y | 4/2006 |
| CN | 200967965 | Y | 10/2007 |
| CN | 201043275 | Y | 4/2008 |
| CN | 201241340 | Y | 5/2009 |
| FR | 2721955 | A1 | 1/1996 |

* cited by examiner

LOCKING CORE PLUG

CROSS-REFERENCE TO RELATED APPLICATIONS

This application is a 371 of PCT/CA2010/000733, filed May 12, 2010, which claims the benefit of U.S. Provisional Application No. 61/177,615, filed on May 12, 2009.

FIELD

Plugs for locking in a core hole

BACKGROUND

When doing roadwork it is sometimes desirable to make a temporary hole in the asphalt or pavement. This may be done, for example, when trying to locate utility lines prior to directional drilling under the roadway. These holes are then covered either by a large rectangular plate, or filled with a plug, which has a plate with a cylindrical portion that matches the approximate size of the hole. An example of a core hole plug is described in U.S. Pat. No. 6,662,490 (Aesch, Jr.) entitled "Core Hole Plug Assembly."

SUMMARY

There is provided a locking core plug, comprising an upper plate, an insertion portion extending outward from the upper plate and forming an outer perimeter, and a locking mechanism positioned within the outer perimeter of the insertion portion. The locking mechanism comprises a rotating member that rotates about an axis, a plurality of locking arms, each locking arm having a first end connected to the rotating member at a point offset from the axis of the rotating member, and a second end extending outward toward holes in the outer perimeter; and a plurality of guides fixedly mounted relative to the upper plate. Each guide engaging a corresponding locking arm to convert the circular movement of the first end of the arm as rotating member rotates into an outward movement of the second end from a release position retracted toward or within the outer perimeter of the insertion portion to a locking position extended outward from the outer perimeter of the insertion portion.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
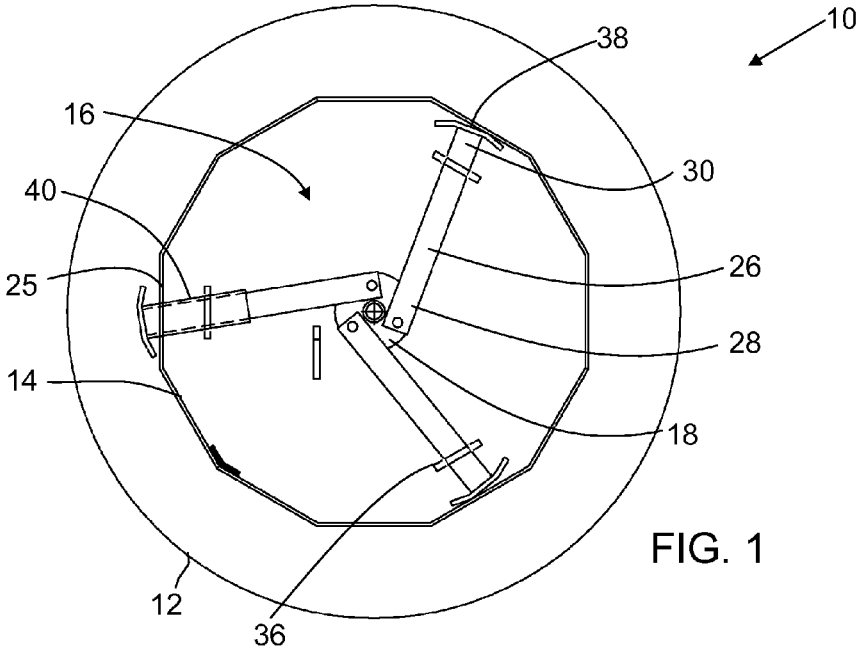
FIG. 1 is a bottom plan view in partial section of a locking core plug in the release position.

A locking core plug, generally identified by reference numeral 10, will now be described with reference to FIGS. 1 through 9.

Structure and Relationship of Parts

Referring to FIG. 1, locking core plug 10 includes an upper plate 12, an insertion portion 14 extending outward from upper plate 12 and forming an outer perimeter, and a locking mechanism generally indicated by reference numeral 16 positioned within the outer perimeter of insertion portion 14. While not shown, there is preferably a bottom plate attached to the bottom of insertion portion 14 that forms outer perimeter into an enclosure to protect locking mechanism 16.

Figure 5:
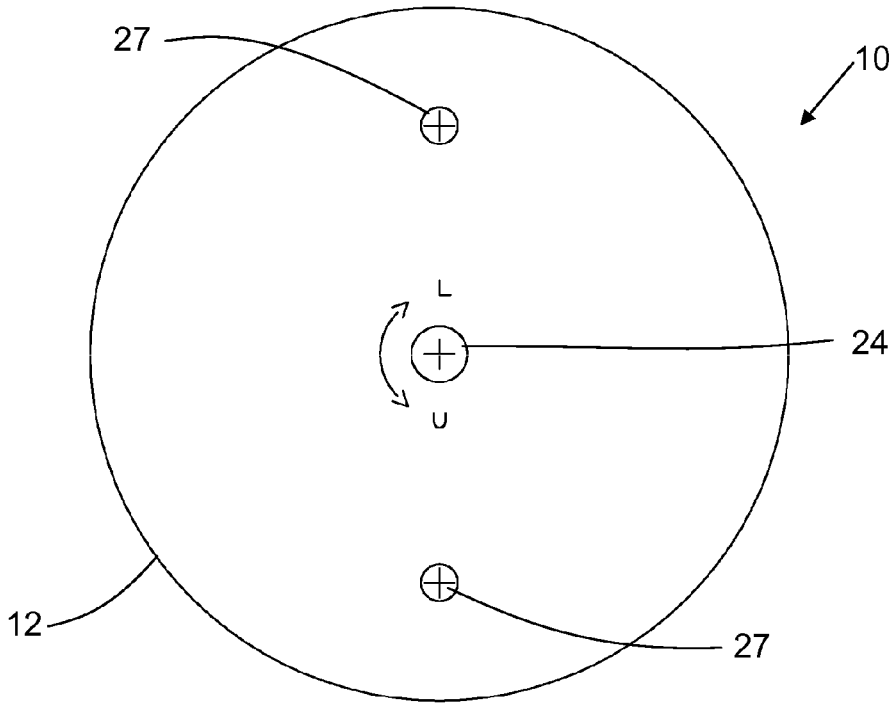
FIG. 5 is a top plan view of a locking core plug.
Figure 7:
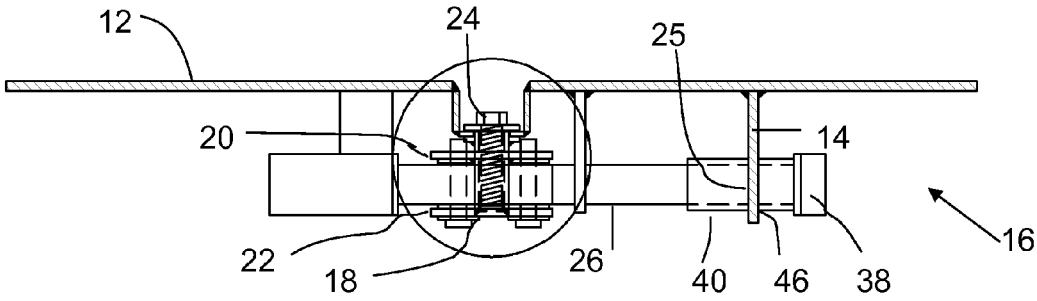
FIG. 7 is a side elevation view in section of a locking core plate showing the locking mechanism.
Figure 8:
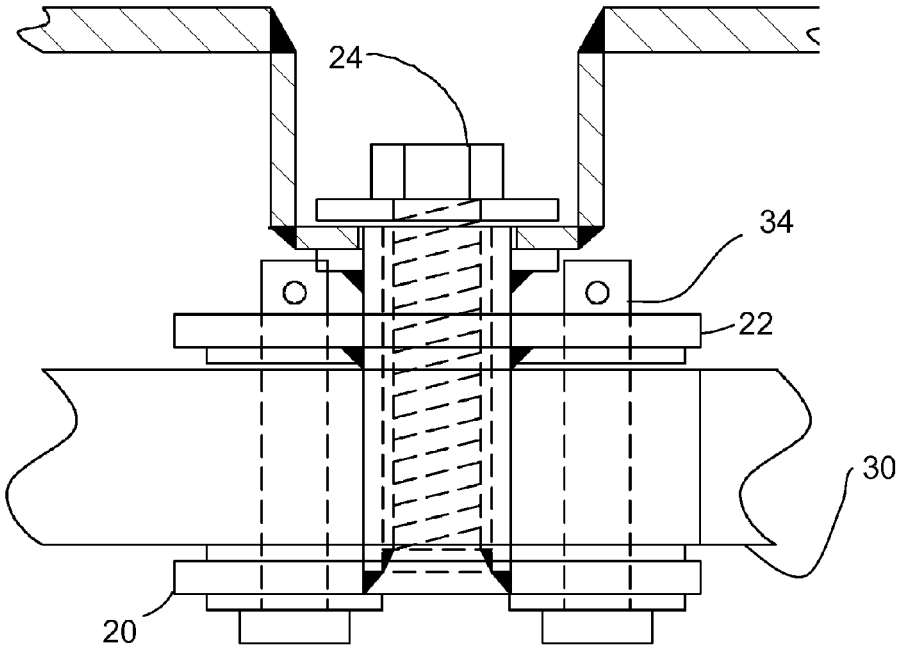
FIG. 8 is a detailed side elevation view in section of the locking mechanism.

Referring to FIGS. 7 and 8, locking mechanism 16 has a rotating member 18 that rotates about an axis. As shown, rotating member 18 has a two-part plate portion 20 and 22 and a bolt head 24 extending upward from plate portions 20 and 22. Bolt head 24 is adapted to receive a wrench or socket wrench, and may be a traditional bolt head, or a specialty bolt head for security reasons. FIG. 5 depicts a top view of locking core plug 10 showing the position of bolt head 24, as well as holes 27 similar to those found on manhole covers that may be used to help install and remove core plug 10. As shown in FIG. 7, bolt head 24 is recessed from upper plate 12. Referring to FIG. 1, a plurality of locking arms 26 are provided that are intended to be extended in the locking position to engage the sides of a core hole, and to be retracted when installing or removing core plug 10. Preferably, there are three locking arms as in the depicted embodiments, however it will be understood that a different number of arms may be used depending on the circumstances.

Figure 2:
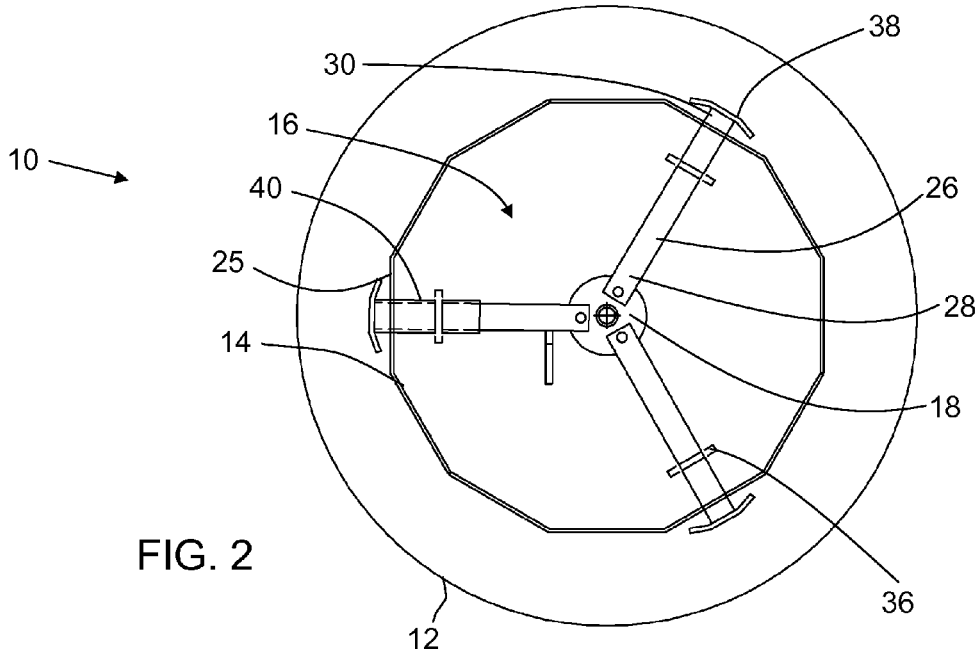
FIG. 2 is a bottom plan view in partial section of a locking core plug in the locking position.
Figure 6:
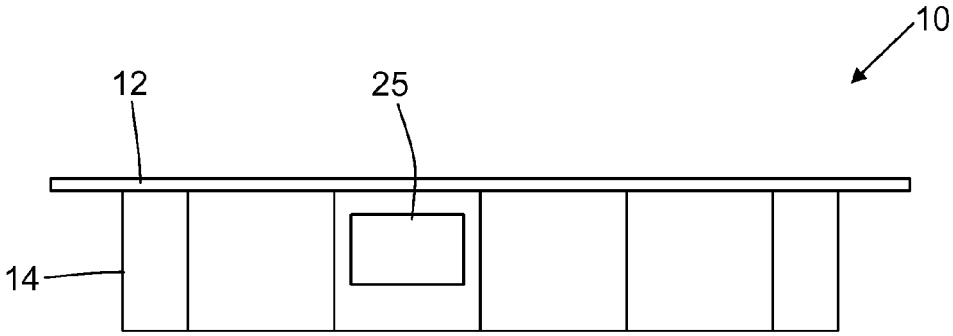
FIG. 6 is a side elevation view of a locking core plug.

Each locking arm 26 has a first end 28 connected to rotating member 18 at a point offset from its axis of rotation, and a second end 30 extending outward toward holes 25 in the outer perimeter of insertion portion 14. FIG. 6 shows a side view of core plug 10 with the general position of hole 25. Referring to FIGS. 7 and 8, in the depicted embodiment second ends 30 are mounted by a pin connection 34 that extends through plate portions 20 and 22 and second end 30. Pin connection 34 allows second end 30 to rotate relative to rotating member 18. Referring to FIG. 1, a plurality of guides 36 are fixedly mounted relative to upper plate 12, each guide 36 engaging a corresponding locking arm 26 to convert the circular movement of first end 28 of locking arm 26 into substantially linear movement of second end 30 between from a release position retracted toward or within the outer perimeter of insertion portion 14 as shown in FIG. 1 and a locking position extended from the outer perimeter of insertion portion 14 as shown in FIG. 2.

Figure 3:
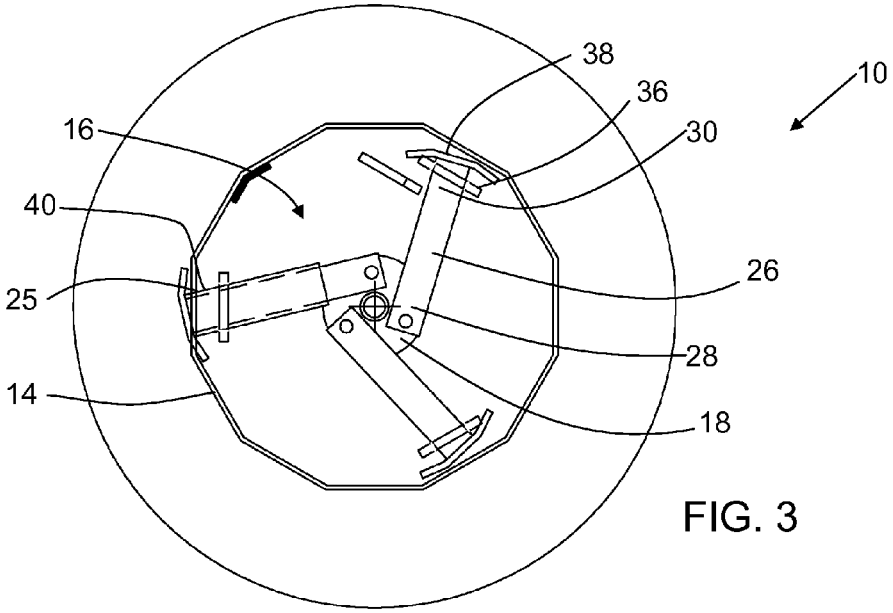
FIG. 3 is a bottom plan view of a locking core plug for a smaller hole.
Figure 4:
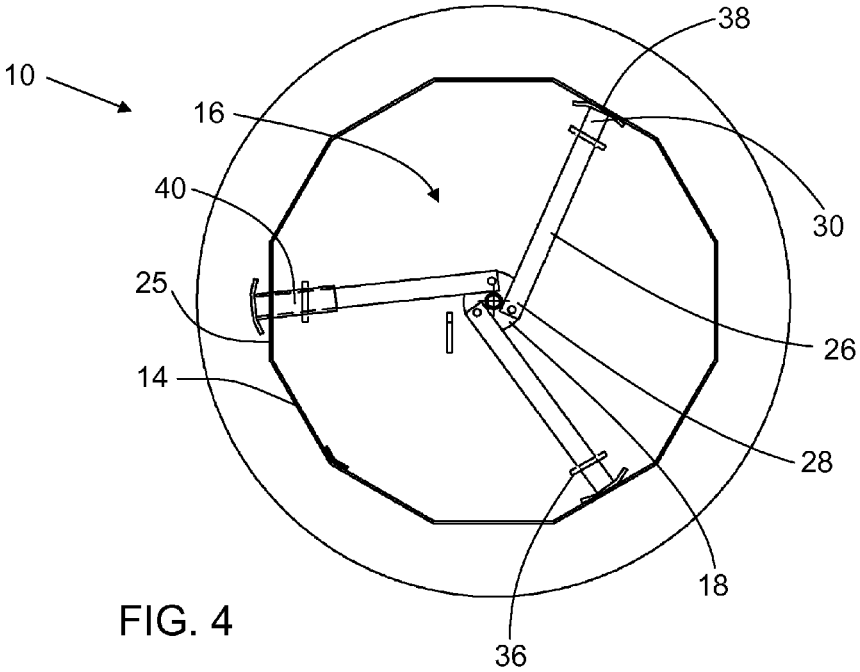
FIG. 4 is a bottom plan view of a locking core plug for a larger hole.
Figure 9:
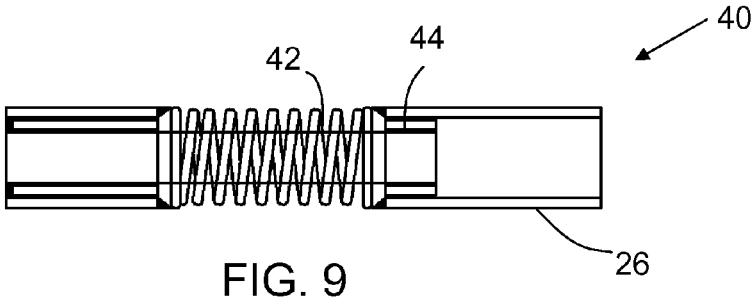
FIG. 9 is a detailed side elevation view of a portion of the length-adjustable shoe arm.

As shown, each locking arm 36 terminates in a surface-engaging shoe 38, and at least one locking arm 36 has a spring-loaded length adjustable member 40. Referring to FIG. 9, spring-loaded adjustable member 40 has a spring 42 mounted on a pin 44, all of which is covered by a sleeve 46 as shown in FIG. 7, which also acts as a guide to ensure linear movement of adjustable member 40. Adjustable member 40 is able to ensure there is outward pressure from locking arms 36 on the sides of any hole being plugged. Adjustable member 40 also allows core plug 10 to be used in situations where the hole being plugged may not be a perfect circle, or the precise size. FIGS. 3 and 4 shows core plugs 10 for different sizes of core holes. The most common sizes of holes are 12", 18", and 24", although core hole plug 10 may be made for any practical size of hole.

Advantages

By locking plug 10 in the hole, this reduces the risk that plug 10 will be removed, either by unauthorized persons, or by a vehicle travelling over it, either of which may result in damage or injury.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

The invention claimed is:

1. A locking core plug, comprising:

an upper plate having an outer circumference;

an insertion portion extending outward from the upper plate and forming an outer perimeter;

a locking mechanism positioned within the outer perimeter of the insertion portion, the locking mechanism comprising:

a rotating member that is rotatable about a central axis of the rotating member, the central axis extending perpendicular to the upper plate and parallel to the insertion portion;

a plurality of locking arms, each of the locking arms having a first end connected to the rotating member at a respective point offset from the axis of the rotating member, and each of the locking arms having a second end adjacent a respective one of a plurality of holes in the insertion portion, each of the second ends comprising a surface engaging shoe, at least one of the locking arms comprising a length adjustable locking arm having a spring-loaded telescoping connection between the first end and the second end thereof, the spring-loaded telescoping connection biasing the surface engaging shoe of the length adjustable locking arm toward an extended position and permitting the surface engaging shoe of the length adjustable locking arm to retract in when in contact with an inner surface of a core hole;

a plurality of guides fixedly mounted to the upper plate, each of the guides engaging a corresponding one of the locking arms, the guides converting a circular movement of the first ends of the locking arms as the rotating member rotates into a generally linear movement of the second ends of the locking arms, the locking arms each being moveable between a release position in which the second end of each of the locking arms is retracted toward or within the insertion portion and a locking position in which the second end of each of the locking arms is extended outward from the insertion portion such that the surface engaging shoe is spaced between the outer perimeter of the insertion portion and the outer circumference of the upper plate.

2. The locking core plug of claim 1, wherein the rotating member comprises a bolt head for engaging a wrench.

3. The locking core plug of claim 1, wherein the insertion portion has a diameter of between 12 and 18 inches.

4. The locking core plug of claim 1, wherein the spring-loaded telescoping connection comprises a sleeve.

* * * * *